United States Patent [19]

Yamashita

[11] 4,389,009

[45] Jun. 21, 1983

[54] HIGH SPEED TAPE FEEDER

[76] Inventor: Kyoichi Yamashita, 2361 Nippa-cho, Kohoku-ku, Yokohama-shi, Kanagawa 223, Japan

[21] Appl. No.: 268,567

[22] Filed: May 29, 1981

[30] Foreign Application Priority Data

May 30, 1980 [JP] Japan ..... 55-71441

[51] Int. Cl.[3] ..... B65H 17/22

[52] U.S. Cl. ..... 226/188; 226/190

[58] Field of Search ..... 226/181–186, 226/188, 190, 194, 10, 24, 28–31, 44; 242/206, 208–210; 250/570, 571; 83/74, 75

[56] References Cited

U.S. PATENT DOCUMENTS

| | | | |
|---|---|---|---|
| 3,186,273 | 6/1965 | Tomberg | 83/74 |
| 3,559,568 | 2/1971 | Stanley | 226/28 X |
| 3,899,946 | 8/1975 | Niepmann | 83/75 |
| 4,081,944 | 4/1978 | Sjostrand | 226/28 X |
| 4,158,429 | 6/1979 | Ohmori | 226/34 |

*Primary Examiner*—Leonard D. Christian
*Attorney, Agent, or Firm*—Armstrong, Nikaido, Marmelstein & Kubovcik

[57] ABSTRACT

An improvement in a high speed tape feeding apparatus comprising a pair of cylindrical drums rotatable in tangential contact so as to pull a tape out of the roll of tape by frictionally driving the tape therebetween, one of the pair of drums being mounted for free rotation on a first drive shaft and having a circumference slightly longer than the length of one section to be cut from the tape, the tape having identical patterns and check marks printed thereon and to be cut into sections bearing one printed pattern, the other drum being mounted for free rotation on the second drive shaft and having a circumference slightly shorter than the length of one section to be cut from the tape, an electromagnetic clutch between the first drum and the first drive shaft, a unidirectional shaft between the other drum and the second drive shaft, photoelectric sensing apparatus for detecting two successive check marks on the tape, and producing signals, and a mechanism for bringing the electromagnetic clutch into and out of transmission engagement under the control of the photoelectric apparatus. The structure for the electromagnetic clutch is presented and structure for the unidirectional clutch is disclosed.

4 Claims, 9 Drawing Figures

HIGH SPEED TAPE FEEDER

BACKGROUND OF THE INVENTION

This invention relates to tape feeding apparatus and, more particularly, to an apparatus for feeding a pattern-printed tape to a cutting machine at a high speed.

Apparatus for feeding a tape from its roll at a constant speed for the purpose of printing or cutting are well known in the art. Such feeding apparatus generally use a drum rotating at a constant speed to pull the tape.

Generally, a tape is fed at a constant speed to a cutting machine operating at a constant rate where the tape is cut into sections of an equal length. However, a problem arises when a tape has a series of the same patterns already printed thereon before it is fed to a cutting machine operating at a constant rate where it is cut into sections, each bearing one printed pattern. Pattern-bearing sections are ready for use as labels, for example. In such a case, however, constant feeding of the tape may be undesirable because individual pattern-bearing sections of the tape are not exactly equal in length.

The factors causing variations in length of individual pattern-bearing sections are accumulation of slight errors of the position of patterns on the tape during printing, accumulation of expansion and/or shrinkage of the tape itself during printing, elongation of the tape resulting from high speed feeding under increased tension, influence of humidity, conditions under which the roll of tape is stored, slippage of tape and interference by the roll of tape occurring when the tape is taken out, and the like. Under these circumstances, if the tape is fed at a constant speed and cut to an equal fixed length, the actual position of cutting will accumulatively deviate from the desired cutting position just intermediate the adjacent patterns.

Therefore, an object of the present invention is to provide a tape feeding apparatus wherein a tape having a series of patterns printed thereon is fed at a high speed and accurately in a one-by-one pattern to a cutting machine operating at a constant rate.

SUMMARY OF THE INVENTION

According to the present invention, there is provided an apparatus for feeding at a high speed a tape having a series of the same patterns and check marks printed thereon. The tape is to be cut into sections; each section bearing one printed pattern. The feeding apparatus comprises a pair of cylindrical drums rotatable in tangential contact so as to pull the tape out of its roll by frictionally driving the tape therebetween. One of said pair of drums is mounted for free rotation on a first drive shaft and has a circumference slightly longer than the predetermined length of one section cut from the tape. The other drum is mounted for free rotation on a second drive shaft and has a circumference slightly shorter than the predetermined length of one section. An electromagnetic clutch is provided between the one drum and the first drive shaft while a undirectional clutch is provided between the other drum and the second drive shaft. The electromagnetic clutch is brought into and out of transmission engagement under the control of photoelectric means for detecting two successive check marks on the tape. The unidirectional clutch normally transmits the driving force from the second drive shaft to the other drum, but allows the other drum to be rotated with the one drum in frictional contact with the other drum and rotating at a higher circumferential speed.

BRIEF DESCRIPTION OF THE DRAWINGS

These and other objects and advantages of the invention may be readily understood by referring to the following description and appended drawings in which.

FIGS. *6a, 6b* and *6c* are detail views which illustrate the different positions of two successive marks on the tape relative to a pair of photoelectric detectors.

DESCRIPTION OF THE PREFERRED EMBODIMENT

Figure 1:
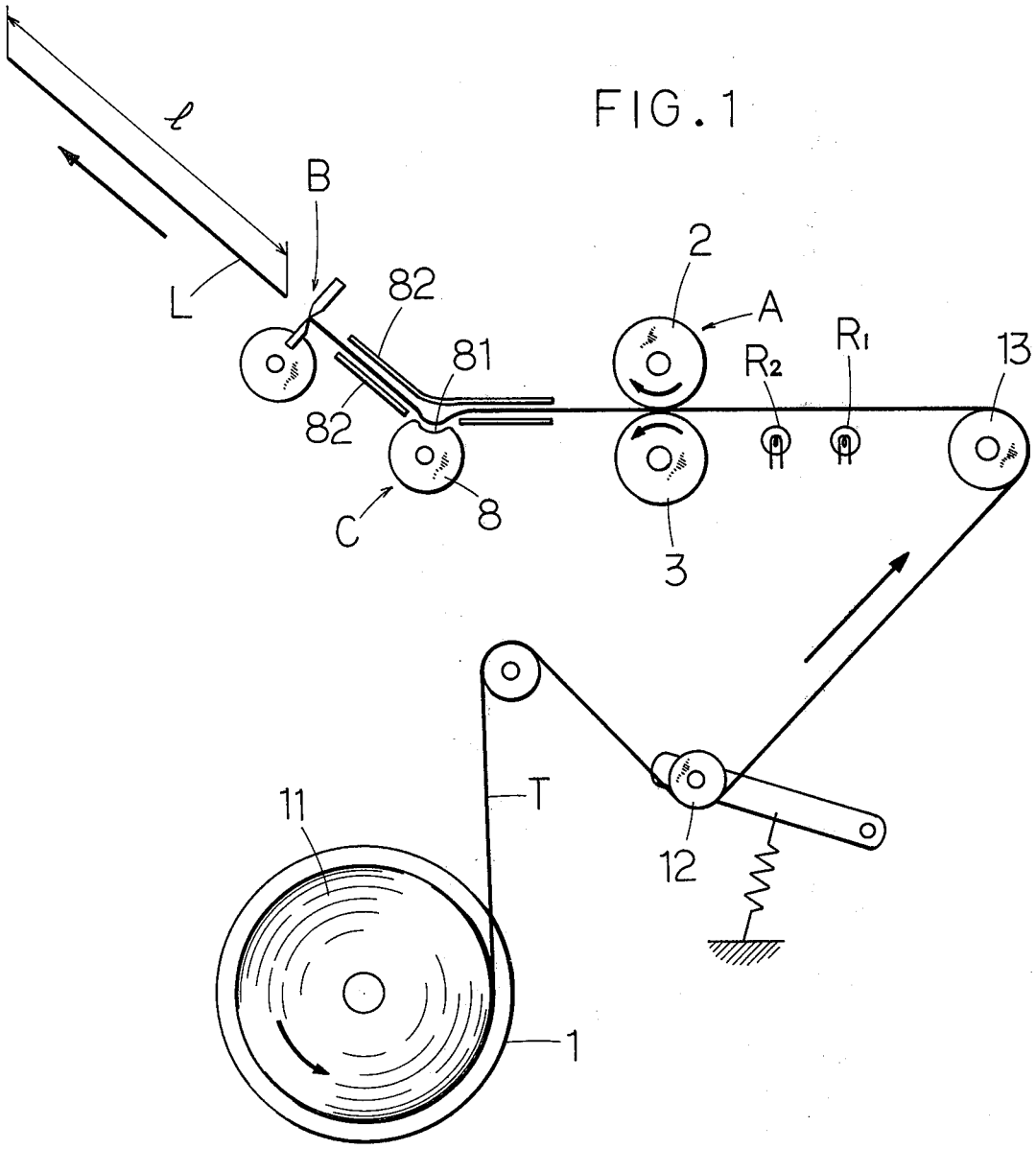
FIG. 1 is a view which schematically illustrates an overall arrangement for taking a tape out of its roll to a cutter.

Referring to FIG. 1, an overall arrangement is schematically shown including a roll of tape, photoelectric detecting means, a feed apparatus, a feed regulator and a cutter. Numeral 1 designates a rotatable disc on which a roll 11 of tape is placed. It is to be noted that a tape T has a series of the same patterns already printed thereon. The tape T is unwound from the roll 11 by means of a feed apparatus A through a tension roller 12 and a guide roller 13. The feed apparatus A takes the tape T out of the roll 11 and feeds it to a cutter B where the tape T is cut into sections in the form of labels L which are transferred to the subsequent station where they are applied to the surface of bottles or containers.

Figure 2:
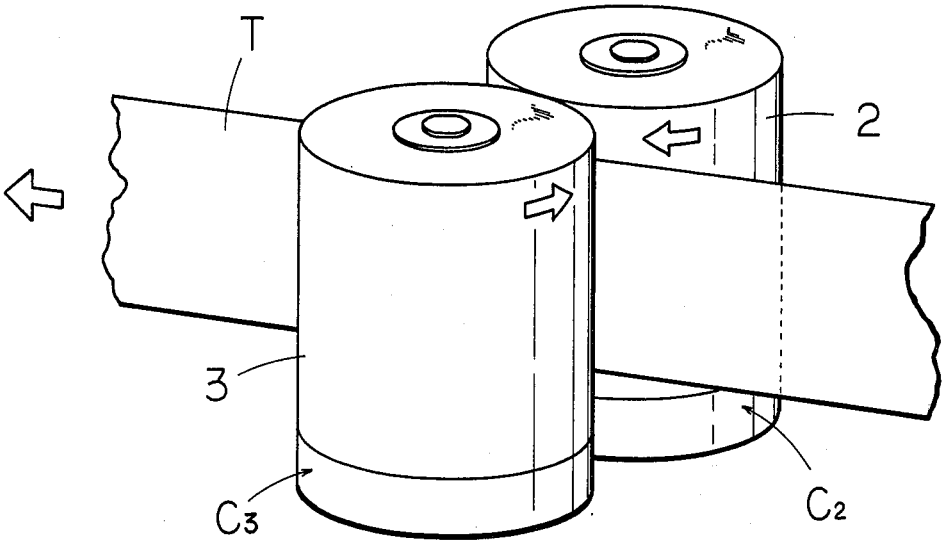
FIG. 2 is a perspective view of a pair of drums according to the present invention.
Figure 3:
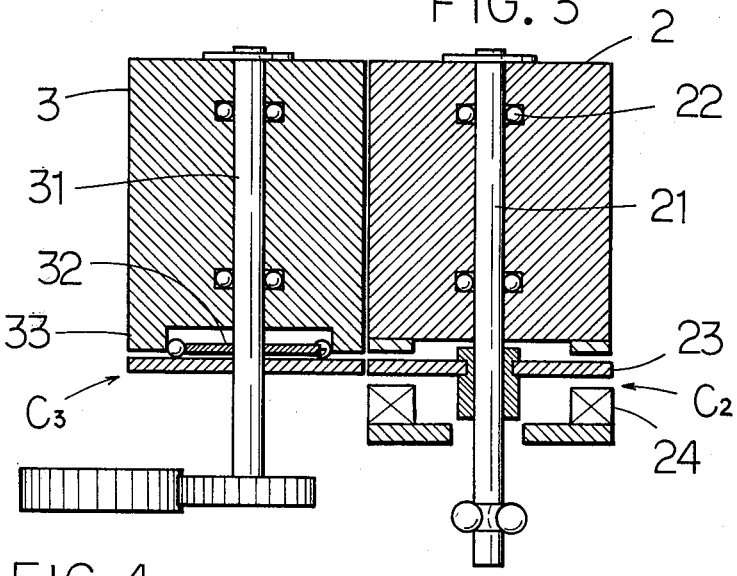
FIG. 3 is an axial cross-sectional of the drums of FIG. 2.

The feed apparatus A is illustrated in FIGS. 2 and 3 as comprising a pair of cylindrical drums 2 and 3 arranged in tangential contact with each other.

One drum 2 has a circumference which is slightly longer than the length of one section cut from the tape or a label L, and has a circumferential surface portion made of a material having a relatively high coefficient of friction, such as rubber. The other drum 3 has a circumference which is slightly shorter than the length of a label L and has a circumferential surface portion made of a material having a lower coefficient of friction than that of the one drum 2. One and the other drums 2 and 3 are referred to as "larger" and "smaller" drums hereinafter. Provided that the length of an ideal pattern-bearing section or label L is l, the larger drum 2 has a circumference of $(l+d)$, while the smaller drum 3 has a circumference of $(l-d)$ wherein d is a difference.

As seen from FIG. 3, the larger drum 2 is mounted for free rotation on a drive shaft 21 which is rotated at a constant rate of revolution by means of a drive motor (not shown). Also mounted on the drive shaft 21 is an electromagnetic clutch $C_2$ which serves to transmit the driving force from the shaft 21 to the larger drum 2. The electromagnetic clucth for the transmission of driving force may be any of well known clutch mechanisms and the typical construction thereof is shown in FIG. 3 by way of illustration, but not for limitation.

In the illustrated embodiment, the larger drum 2 is mounted on the drive shaft 21 via bearings 22 for free rotation. Below the larger drum 2 a clutch disc 23 is mounted for axial motion on the drive shaft 21.

However, the disc 23 is restrained with respect to the drive shaft 21 in a direction of rotation. The disc 23 always rotates with the shaft 21. Placed below the disc is an electromagnet 24 which is electrically associated with a photoelectric detector to be described below. Energization of the electromagnet 24 urges the disc 23 upward into engagement with the drum 2. Then the driving force of the drive shaft 21 is selectively transmitted to the drum 2 through the disc 23 in response to an input to the electromagnet 24.

On the other hand, the smaller drum 3 is associated with a unidirectional clutch $C_3$. This clutch may be any of well-known unidirectional clutch mechanisms, and the typical construction thereof is shown in FIG. 3 by way of illustration, but not for limitation.

Figure 4:
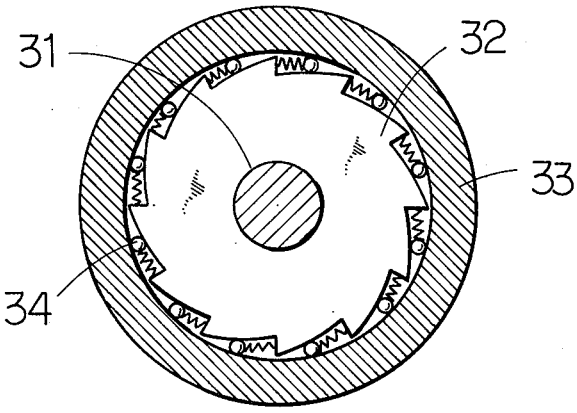
FIG. 4 is a cross-section taken along line IV—IV in FIG. 3.

In the illustrated embodiment, the smaller drum 3 is mounted for free rotation on the drive shaft 31 via bearings. The smaller drum 3 at the bottom has an annular rim 33 defining a circular recess. A gear 32 fixedly secured to the drive shaft 31 is received in the recess. As shown in FIG. 4, a plurality of steel balls 34 are placed in spaces defined between the inner wall of the rim 33 and the teeth of the gear 32. The rim 33 has a circular inner wall, while the teeth of the gear 32 are oriented and slanted in one direction opposite to the direction of rotation shown by an arrow. The balls 34 are each biased by individual springs 35 in the one direction. When the shaft 31 and the gear 32 rotates in the direction shown by the arrow, the balls are firmly held between the slanted surface of the gear tooth and the inner wall of the rim 33. In this way, the driving force of the shaft 31 is transmitted to the rim 33 and, hence, to the smaller drum 3 via the gear 32 and the balls 34. It should be understood that with this arrangement, the smaller drum 3 is allowed to rotate at a higher speed than the rotational speed of the drive shaft 31 in the same direction as the latter.

Figure 6A:
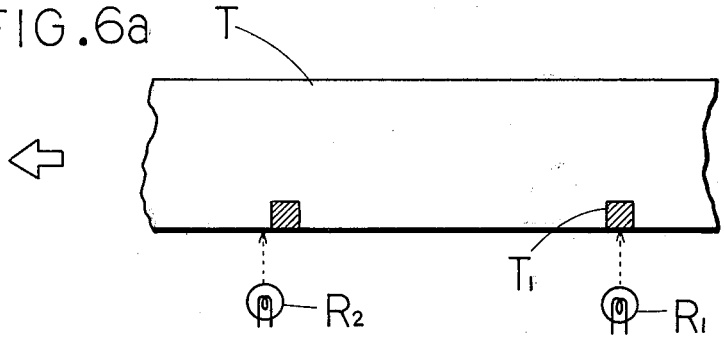

In addition to a series of patterns, the tape T also has a series of marks $T_1$ as shown in FIG. 6*a*, which are preferably printed in black on the back of the tape. Each mark is intermediate two successive patterns in this example. The distance between two successive marks is equal to the length l of a label L to be cut from the tape. Each mark $T_1$ has a width a.

The photoelectric detecting means includes a pair of photoelectric detectors $R_1$ and $R_2$ arranged parallel to the tape path and spaced apart from each other a distance which is shorter than (l+a) but longer than l.

Each photoelectric detector includes a light-emitting and a light-receiving section built in and is adapted to be turned on when the light receiving section receives the light which is emitted from the light emitting section and reflected by reflective portions on the tape where black marks are absent. Such photoelectric detectors are commercially available. Other types of detectors may also be used herein.

The output of the upstream photoelectric detector $R_1$ generated when the absence of a black mark is detected serves to disconnect the electromagnetic clutch $C_2$. On the contrary, the output of the downstream photoelectric detector $R_2$ generated when the absence of a black mark is detected serves to actuate the electromagnetic clutch $C_2$ through, for example, a conventional holding relay circuit.

The photoelectric detectors $R_1$ and $R_2$ are not continuously energized, but rather are energized once per revolution of the shafts 31 and 31.

Figure 5:
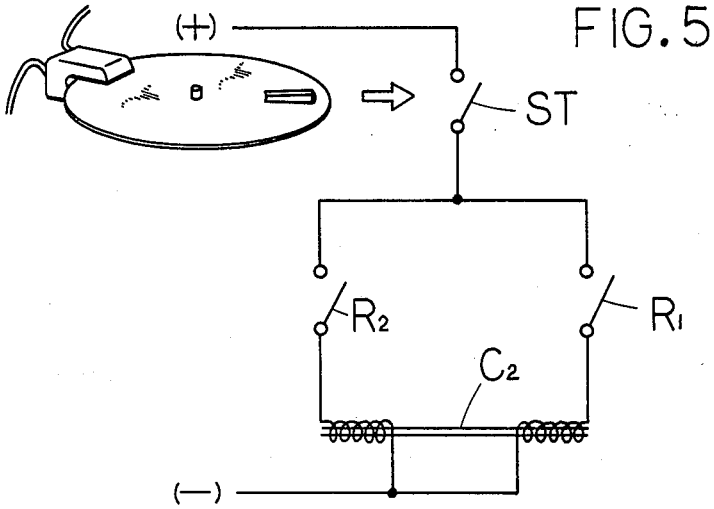
FIG. 5 is a diagram illustrating a signal transmission system.

To accomplish this, a timing switch ST is inserted between a power source and the photoelectric detectors $R_1$ and $R_2$ as shown in FIG. 5. The timing switch ST may be in the form of another photoelectric detector combined with a disc having a slit formed therein. The disc rotates at the same rate of revolution as the drive shafts 21 and 31 for the drums 2 and 3. The timing switch ST is thus closed once per revolution of the drive shafts 21 and 31. The photoelectric detectors $R_1$ and $R_2$ are actuated only at this instant.

A circuit diagram showing a holding relay circuit as used in FIG. 5 is shown in FIG. 6. At the instant when the timing switch ST turns on the photoelectric detectors $R_1$ and $R_2$, if the detector $R_2$ senses the absence of black mark, then relay $RY_2$ is actuated. Since relay $RY_1$ is normally closed, switch $SW_2$ is closed, thereby energizing electromagnetic clutch $C_2$ to engage disc 23 with drum 2 allowing drive shaft 21 to drive drum 2.

If, at a later instant in time when timing switch ST turns on the photoelectric detectors $R_1$ and $R_2$ and the detector $R_1$ senses the absence of a black mark, relay $RY_1$ is actuated. This opens the circuit to relay $RY_2$, thereby deactivating it. The electromagnetic clutch $C_2$ is de-energized to disengage the disc 23 from the drum 2, thereby making the larger drum 2 independent of the drive shaft 21.

The tape feeding arrangement shown in FIG. 1 further includes a feed regulator means C in the tape path. The feed regulator C consists of parallel curved guide plates 82 and a rotating drum 8 in this Example. When the tape T is intermittently cut by means of the cutter B during the continuous feed of the tape T by means of the drums 2 and 3, a portion of the tape downstream of the cutter is interrupted in its advance by the cutter for an instant. This interference by the cutter causes the downstream tape portion to be somewhat deflected as the tape is continuously fed. The feed regulator C serves not only to absorb this deflection of the tape, but also to rapidly feed the tape with the aid of the elasticity of the tape itself immediately after cutting is completed or the interference by the cutter is eliminated from the tape path.

Some tapes can absorb such deflection by themselves because of their quality. Provision of the guide plates 82 will suffice in such a case. However, in most cases, a feed regulator is preferably provided in the form of a channelled drum 8. The drum 8 is at the curve of the tape path and has an axially extending channel 81 formed at the outer surface. The drum 8 rotates, the channel 81 receives an excess portion of the tape deflected at the time of cutting to absorb the deflection and then accelerates the forward feed of the tape immediately after cutting is completed.

The channelled drum 8 may be replaced by a single plate which extends parallel to the width of the tape and is reciprocatable perpendicular to a plane tangent to the curved tape. The plate is retracted to absorb an excess length of the tape at the time of cutting and then advanced to assist in feeding the tape forward.

The operation of the above-mentioned arrangement is described below:

Tape Setting

Figure 6B:
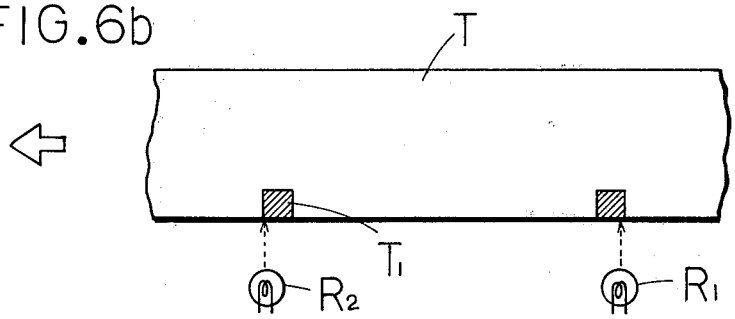

The leading edge of the tape T is manually unwound from the roll 11, trained around the tension and guide rollers 12 and 13 and then between the drums 2 and 3, and led to the position of the cutter B. At this point, the photoelectric detectors $R_1$ and $R_2$ and the timing switch ST (the position of the slit) are adjusted so that both the detectors may be aligned with two successive marks $T_1$ and actuated only at the time of alignment, as shown in FIG. 6*b*.

In this connection, the spacing between the upstream and downstream detectors $R_1$ and $R_2$ is longer than the length l of one pattern-bearing section cut from the tape, but shorter than the length l plus the width a of a mark. More specifically, the detector spacing rather approximates to the length l plus the width a; that is, the distance between the outer sides of two successive marks so that the detectors are very sensitive to deviation of marks from the position of the detectors.

Overfeed of Tape

Figure 6C:
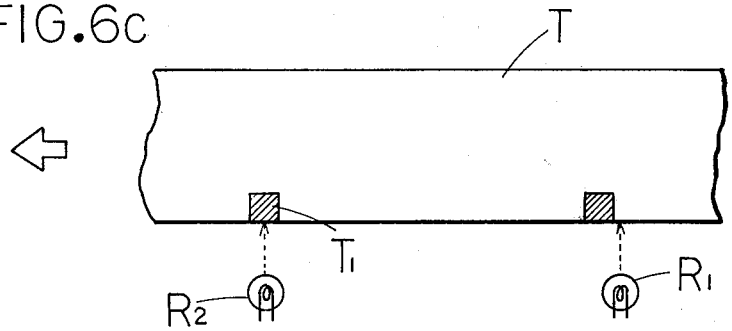
Figure 7:
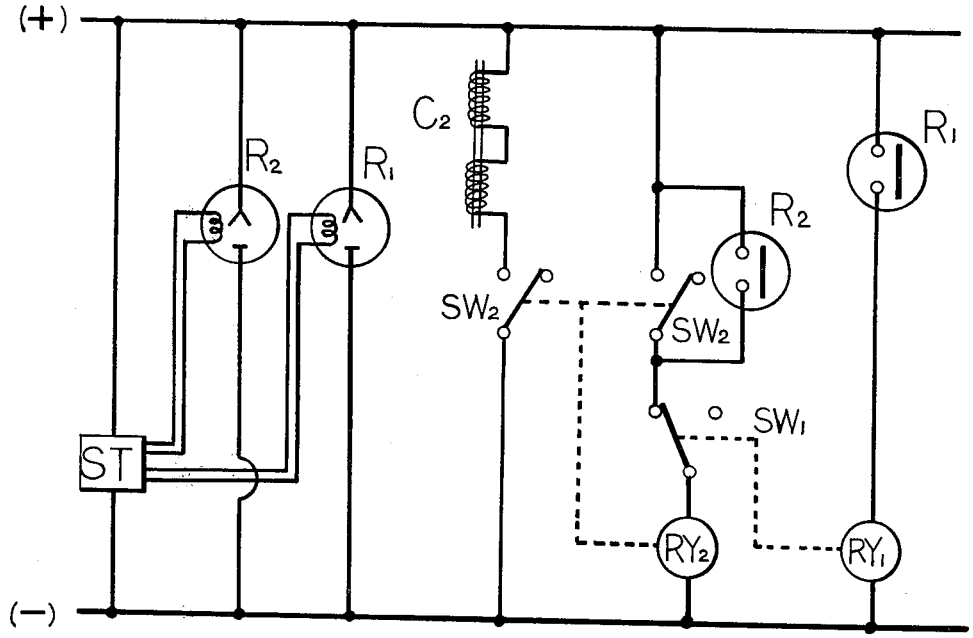
FIG. 7 is a circuit diagram for the signal transmission system of FIG. 5.

If the tape T is fed by means of the larger drum 2 having a circumference slightly longer than the length of a label, the rate of feed is slightly higher. The tape is slightly overfed. Eventually, the following one of the two successive marks goes beyond the position of the upstream detector $R_1$ at the time of actuation of the photoelectric detectors as shown in FIG. 6*c*.

The turning-on of the detector $R_1$ breaks the contact $R_1'$ in the circuit shown in FIG. 5. Then the electromagnetic clutch $C_2$ associated with the larger drum 2 is de-energized to disengage the disc 23 from the drum 2, thereby making the larger drum 2 independent of its drive shaft 21.

At this point, the larger drum 2 reduces its circumferential speed to that of the smaller drum 3, which is now rotated at a constant revolution by means of its drive shaft 31. The rate of feed of the tape is reduced to the circumferential speed of the smaller drum 3. As a result, at the time of the next actuation, lights emitted by the detectors $R_1$ and $R_2$ are both absorbed by the next two successive black marks as shown in FIG. 6*b*. Neither the upstream detector $R_1$ nor the downstream detector $R_2$ is turned on.

Underfeed of Tape

The smaller drum 3 continues to feed the tape.

The tape is fed at a slightly lower rate. When the delay of tape feed exceeds an allowable range (which depends on the degree of approximation of the distance between the upstream and the downstream detectors $R_1$ and $R_2$ to the distance (l+a) between the outer sides of the two successive marks), the preceding one of the two successive marks goes behind the position of the downstream detector $R_2$ as shown in FIG. 6*a*. Then the downstream detector $R_2$ detects the absence of a black mark and is turned on.

The turning-on of the detector $R_2$ marks the contact $R_2'$ in the circuit shown in FIG. 5. Then the electromagnetic clutch $C_2$ associated with the larger drum 2 is energized to engage the disc 23 with the drum 2, thereby allowing the drive shaft 21 to drive the drum 2. The larger drum 2 rotates at a higher circumferential speed than the smaller drum 3, but the smaller drum 3 is allowed to rotate at a higher revolution than that of its drive shaft 31 by virtue of the unidirectional clutch $C_3$. The rate of feed of the tape is increased to the circumferential speed of the larger drum 2.

As a result, at the time of the next actuation, lights emitted by the detectors $R_1$ and $R_2$ are both absorbed by the next two successive black marks as shown in FIG. 6*b*. Neither the upstream detector $R_1$ nor the downstream detector $R_2$ is turned on. The effect of the previous closing of the contract $R_2'$ and the actuation of the electromagnetic clutch $C_2$ are sustained.

In this manner, the tape is fed accurately one by one pattern at a high speed to the cutter B. It is to be noted that, at the time of cutting, the cutter interrupts the advance of the following tape portion which is fed without interruption so that the following portion of the tape between the cutter and the feed drums is somewhat deflected from the normal tape path. This deflection is absorbed by the above-mentioned feed regulator C or by the quality of the tape itself. The tape is fed and cut in a smooth manner.

In the arrangement of FIG. 1, the station downstream of the feed apparatus A is a cutter. However, this downstream station may be a duplex printing machine where another pattern or mark is printed on the pattern.

As described above, according to the present invention, the larger drum 2 having a greater circumference and a higher coefficient of friction is mounted on the drive shaft 21 via the electromagnetic clutch $C_2$, whereas the smaller drum 3 having a smaller circumference is mounted on the drive shaft 31 via the unidirectional clutch $C_3$.

With the electromagnetic clutch $C_2$ disconnected, the larger drum 2 is independent of its drive shaft 21 and rotates with the smaller drum 3 which is rotated by means of its drive shaft 31 rotating at a constant revolution. The tape T is fed at a lower rate equal to the circumferential speed of the smaller drum 3.

On the contrary, when the electromagnetic clutch $C_2$ is actuated to connect the larger drum 2 to the disc 23, the larger drum 2 is rotated by its drive shaft 21. The smaller drum 3 is mounted on the shaft 31 via the unidirectional clutch $C_3$ which allows the smaller drum 3 to be forcedly rotated with the larger drum 2. As a result, the tape T is fed at a higher rate equal to the circumferential speed of the larger drum 2.

Irrespective of accumulation of indefinite factors causing variations in length of individual pattern-bearing sections, for example, accumulation of expansion and/or positioning errors of patterns on the tape during printing, expansion of the tape due to the pulling force during tape pulling and the like, the tape can be fed accurately in a one-by-one pattern to the subsequent station operating at a constant rate, for example, a cutter or a duplex printing machine.

What is claimed:

1. In a high speed tape feeding apparatus comprising a pair of cylindrical drums rotatable in tangential contact so as to pull a tape out of the roll of tape by frictionally driving the tape therebetween, said tape having a series of identical patterns and check marks printed thereon to be cut into sections, each bearing one printed pattern, the improvement comprising:

one of said pair of drums being mounted for free rotation on a first drive shaft and having a circumference slightly greater than the length of one section to be cut from the tape;

the other drum being mounted for free rotation on a second drive shaft and having a circumference slightly smaller than the length of one section to be cut from the tape;

an electromagnetic clutch between said one drum and the first drive shaft;

a unidirectional clutch between said other drum and the second drive shaft;

photoelectric means for detecting two successive check marks on the tape producing signals; and means for bringing said electromagnetic clutch into and out of transmission engagement under the control of the photoelectric means.

2. An apparatus according to claim 1 wherein said electromagnetic clutch includes:

a disc mounted for axial motion on the first drive shaft, restrained of relative rotation to the first shaft and having one surface facing the one drum end; and an electromagnet disposed on one side of the disc remote from the one drum;

wherein energization of the electromagnet causes the one surface of the one drum to be in frictional contact with the drum to provide transmission between the first drive shaft and the one drum.

3. An apparatus according to claim 2 wherein said unidirectional clutch normally provides transmission between the second drive shaft and the other drum, and allows the other drum to be rotated at a higher revolution than the second drive shaft.

4. An apparatus according to claim 3 wherein said photoelectric means includes a pair of photoelectric detectors arranged along the tape path and spaced apart a distance which is longer than the predetermined length of one section, but shorter than the predetermined length of one section plus the length of one mark so that both the detectors normally detect the presence of corresponding two successive marks on the tape;

wherein when the upstream detector detects the absence of the corresponding mark, the detector generates a signal to de-energize the electromagnet whereas, when the downstream detector detects the absence of the corresponding mark, the detector generates another signal to energize the electromagnet.

* * * * *